US007241156B1

(12) United States Patent
Margrave et al.

(10) Patent No.: US 7,241,156 B1
(45) Date of Patent: Jul. 10, 2007

(54) ELECTRICAL CONNECTOR WITH CAM LEVER RETAINER

(75) Inventors: Christopher A. Margrave, Warren, OH (US); Robert S. Lesigonich, Chardon, OH (US); Joseph M. Senk, Cortland, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/496,598

(22) Filed: Jul. 31, 2006

(51) Int. Cl.
*H01R 13/62* (2006.01)

(52) U.S. Cl. ..... 439/157; 439/157

(58) Field of Classification Search ..... 439/157, 439/372

See application file for complete search history.

(56) References Cited

U.S. PATENT DOCUMENTS 5,252,084 A * 10/1993 Wakata ..... 439/157
5,938,458 A * 8/1999 Krehbiel et al. ..... 439/157
6,217,354 B1 * 4/2001 Fencl et al. ..... 439/157
6,413,105 B2 * 7/2002 Noro et al. ..... 439/157
6,565,372 B2 5/2003 Bakker et al.
6,705,882 B2 * 3/2004 Casses ..... 439/157
6,739,889 B1 5/2004 Daggett et al.
6,767,250 B2 * 7/2004 Casses et al. ..... 439/587
6,846,191 B2 1/2005 Hobbs et al.

OTHER PUBLICATIONS

U.S. Appl. No. 11/088,420, filed Mar. 24, 2005, Senk; Joseph M., et al.

* cited by examiner

*Primary Examiner*—James R. Harvey
*Assistant Examiner*—Travis Chambers
(74) *Attorney, Agent, or Firm*—David P. Wood

(57) ABSTRACT

An electrical connector has a connector body that is equipped with a cam lever that is pivotally attached to the connector body for movement between a transit position and a lock position. The electrical connector has a retainer to prevent detachment of the cam lever from the connector body during transit.

6 Claims, 1 Drawing Sheet

ELECTRICAL CONNECTOR WITH CAM LEVER RETAINER

BACKGROUND OF THE INVENTION

This invention relates generally to an electrical connector that is destined to become part of an electrical connector assembly.

Some electrical connector assemblies, such as the electrical connector assembly disclosed in U.S. Pat. No. 6,846,191 B2 issued to Jon C. Hobbs et al. Jan. 25, 2005, comprise mating electrical connectors that have relatively high engagement forces. Consequently, the connector bodies of the respective electrical connectors are equipped with a cam lever and cam followers, such as the cam lever 90 and cam followers 96 illustrated in the Hobbs et al. '191 patent. Mating the electrical connectors is mechanically assisted by engaging the cam lever with the cam followers and then pivoting the cam lever to a lock position drawing the electrical connectors together into mating engagement.

For other examples of similar electrical connector assemblies, see U.S. Pat. No. 6,565,372 B2 issued to John H. Bakker, et al. May 20, 2003, for an electrical connector having a cam mating device and U.S. Pat. No. 6,739,889 B1 issued to Barry M. Daggett et al May 25, 2004 for an electrical distribution center assembly.

In many instances, particularly in the case of automotive electrical distribution center assemblies, the cam lever is attached to an electrical connector at one location. The electrical connector with the cam lever is then transported to another location where the electrical connector is attached to a mating electrical connector equipped with cam followers with the mechanical assistance of the cam lever.

SUMMARY OF THE INVENTION

This invention provides a electrical connector that is equipped with a cam lever and a cam lever retainer to prevent detachment of the cam lever during transit of the electrical connector from one location to another location for attachment to a mating electrical connector equipped with cam followers.

DETAILED DESCRIPTION OF THE PREFERRED EMBODIMENTS

Figure 1:
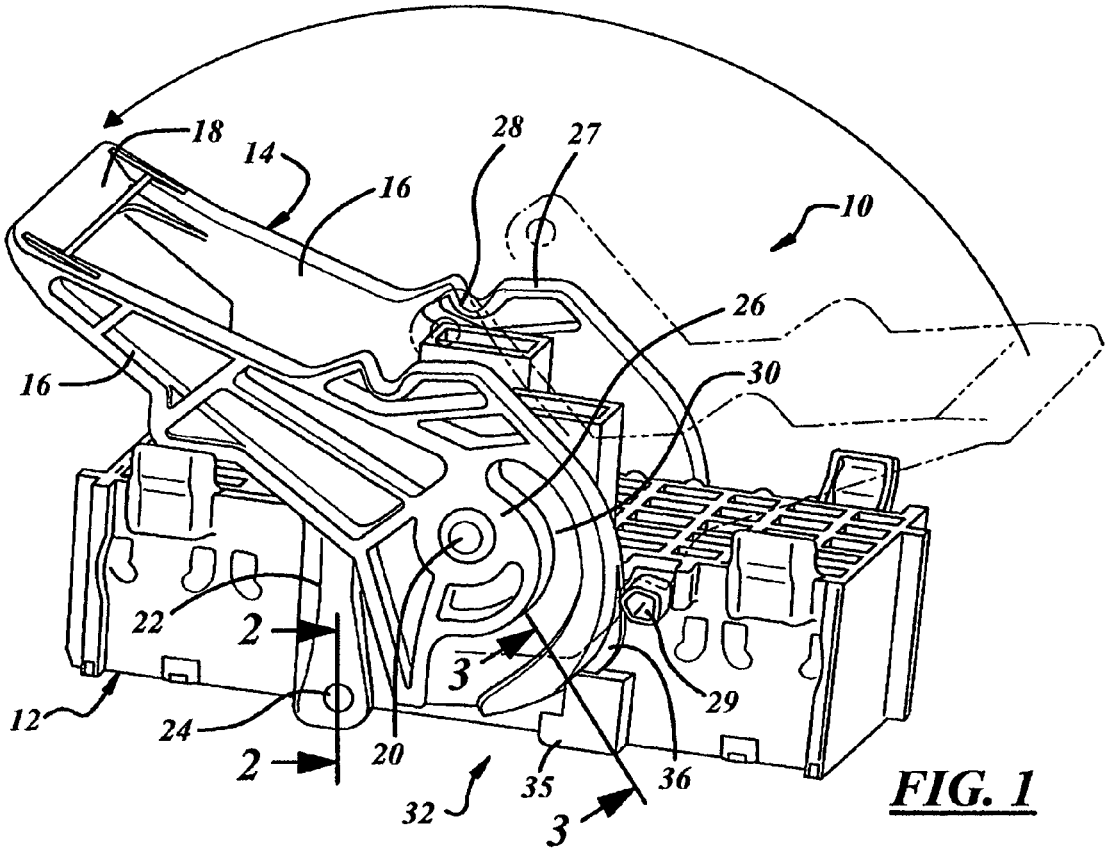
FIG. 1 is a perspective view of an electrical connector that is equipped with a cam lever and a cam lever retainer for illustrating an embodiment of the invention.

Referring now to FIG. 1 an electrical connector 10 comprises a connector body 12 which houses a plurality of terminals (not shown). Electrical connector 10 is designed for attachment to a mating electrical connector (not shown) having another connector body which houses a plurality of complementary terminals to form an electrical connector assembly. When the electrical connectors are mated, the terminals and complementary terminals of the respective electrical connectors engage each other forming several electrical connections as is well known in the art of electrical connectors.

Electrical connector 10 is equipped with a cam lever 14 that is pivotally attached to connector body 12. Cam lever 14 engages cam followers of the mating electrical connector (not shown) to draw the electrical connectors together as explained in more detail below. Cam lever 14 is generally U-shaped with dual cam lever arms 16 that are spaced apart and connected at one end with a bridge 18 that acts as a handle. Cam lever arms 16 are pivotally attached to opposite sides of connector body 12 by pivot pins 20 that project outwardly from the opposite sides of the connector body 12 into pivot holes in the cam lever arms 16. Cam lever arms 16 are pivoted together by bridge 18 from a transit position shown in solid line in FIG. 1 to a lock position shown in dashed line in FIG. 1.

Cam lever 14 is held in the transit position by lock arms 22 that are attached to the respective cam lever arms 16 in cantilever fashion. The free end portions of lock arms 22 have holes that receive lock pins 24 that project outwardly from the opposite sides of the connector body 12 to hold cam lever 14 in the transit position. Cam lever 14 may made of a plastic or other resilient electrically insulative material so that the hub portions 26 of the cam lever arms 16 can be spread apart for pivotal attachment to connector body 12. Hub portions 26 are spread apart, the holes aligned with the pivot pins 20 and then the lever arms 16 are simply released to attach the cam lever 14 pivotally to the pivot pins 20 in an economical manner. The free end portions of lock arms 22 may also be spread apart and their respective holes aligned with the lock pins 24. Lock arms are then also released to hold cam lever 14 in the transit position shown in solid line in FIG. 1. The pins and holes can be reversed, that is, the cam lever arms 16 and/or the lock arms 22 can support pivot or lock pins while the connector body 12 is configured with the cooperating pivot or lock holes.

Cam lever arms 16 have cam slots 30 in their respective outer faces. When electrical connector 10 is plugged a short way into the mating electrical connector (not shown) with the cam lever arms 22 in the transit position shown in solid line in FIG. 1, cam slots 30 receive the cam followers (not shown) of the mating electrical connector. Lock arms 22 also engage ramps (not shown) of the mating electrical connector which spread lock arms 22 apart and disengage the lock arms 22 from the lock pins 24. The two connectors are then drawn together by rotating the cam lever 14 from the solid line transit position shown in FIG. 1 to the dashed line lock position where the electrical connectors are locked together. Cam arm 14 is retained in the lock position by flexible lock beams 27 that include sockets 28 that snap over lock pins 29 attached to the sides of connector body 12. In some instances, cam lever arms 16 may have cam slots in their respective inner faces rather than their outer faces as illustrated in the drawings.

As indicated above in the background, electrical connector 10 may be equipped with cam lever 14 at one location and then transported to another location for connection to the mating electrical connector equipped with the cam followers. Electrical connector 10 is provided with a cam lever retainer 32 that assures that the cam lever 12 does not detach from the connector body 12 during transit.

The cam lever retainer 32 comprises radial channels 34 on opposite sides of connector body 12 and cooperating radial fins 36 on cam lever arms 16. Fins 36 are disposed in the respective channels 34 when cam lever 14 is in the transit position as shown in solid line FIGS. 1 and 3. This prevents the cam lever arms 16 from being spread apart and detaching the cam lever 14 from the connector body 12.

Figure 3:
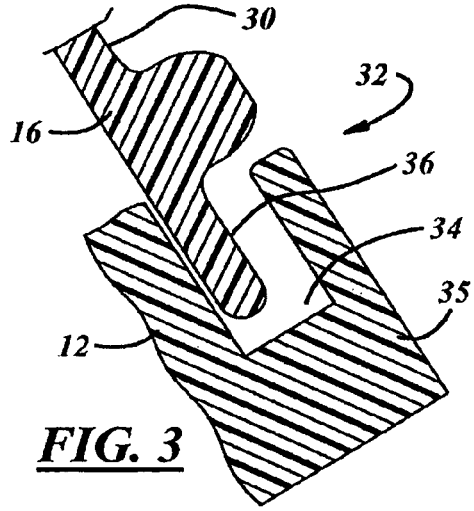
FIG. 3 is a section taken substantially along the line 3—3 of FIG. 1 looking in the direction of the arrows.

Radial channels 34 may be provided in a low profile manner by integral side ears 35 of connector body 12 that are about the same width as the cam lever arms 16 as shown in FIGS. 1 and 3.

Figure 2:
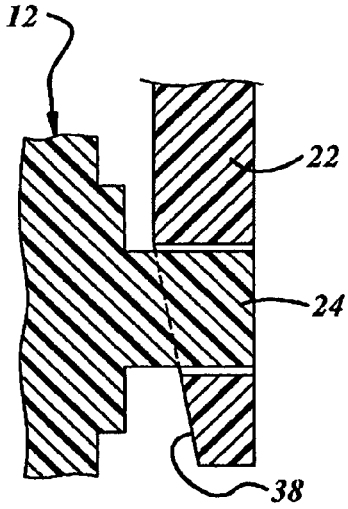
FIG. 2 is a section taken substantially along the line 2—2 of FIG. 1 looking in the direction of the arrows.

As indicated above, cam lever 14 is attached to connector 10 by spreading cam lever arms 16 apart, aligning the pivot holes with the pivot pins 20 and releasing cam lever arms 16. Fins 36 are shaped so that the fins 36 are disposed outside channels 34 during this assembly operation. This can be done, for instance by positioning the cam arms 16 a few degrees counterclockwise from the transit position shown in solid line in FIG. 1. In this case the cam arms 16 can be locked in the transit position simply by rotating the cam lever 14 clockwise to the transit position so that fins 36 enter channels 34 and the lock arms 22 snap over the lock pins 24 and into locked engagement with the lock pins 24. In this regard, the lock arms 22 may include chamfers 38 as shown in FIG. 2 to facilitate snap over assembly, and of course the lock pins 24 may be part of the lock arms 22 rather than the connector body 12 as indicated above.

Fins 36 are shaped so that the fins are at least disposed in channels 34 in the transit position as shown in solid line in FIGS. 1 and 3. Fin 36 may be shaped to remain in the channels 34 until the cam lever 14 reaches the lock position shown in dashed line in FIG. 1. However, in some instances, the mating electrical connector may prevent the cam lever arms 16 from spreading apart in which case the arcuate length of the fins 36 can be shortened as long as the fins 36 prevent the cam lever arms 16 from being spread apart during transit.

While the cam lever retainer 32 has been illustrated as fins 36 of the cam lever 14 engaging in slots 34 of the connector body 12, the parts can be reversed. That is, the cam lever 14 can be shaped with retention slots while the connector body 12 is provided with the cooperating fins.

In other words, it will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. An electrical connector comprising:

a connector body having a resilient U-shaped cam lever comprising dual cam lever arms that are attached by a bridge and that are pivotally attached to the connector body for movement together between a transit position and a lock position, the cam lever arms being poised for engagement with a mating electrical connector when the cam lever arms are in the transit position, and the cam lever arms being configured for locked engagement with the connector body when the cam lever arm are in the lock position, the electrical connector having a lock for locking the cam lever in the transit position, and the electrical connector having a retainer to prevent detachment of the cam lever from the connector body during transit, the retainer comprising fins that are disposed in channels at least when the cam lever is in the transit position wherein one of the fins is part of each cam lever arm and the channels are part of the connector body.

2. The electrical connector as defined in claim 1 wherein the channels are provided by integral ears of the connector body that have substantially the same width as the cam lever arms.

3. The electrical connector as defined in claim 1 wherein the cam lever arms are configured with flexible beams for locked engagement with the connector body when the cam lever arms are in the locked position, the flexible beams having sockets that snap over lock pins projecting from the sides of the connector body.

4. An electrical connector comprising:

a connector body having a resilient U-shaped cam lever comprising dual cam lever arms that are attached by a bridge and that are pivotally attached to the connector body for movement together between a transit position and a lock position, the cam lever arms being poised for engagement with a mating electrical connector when the cam lever arms are in the transit position, the electrical connector having lock arms engaging lock pins of the connector body for locking the cam lever in the transit position, and the electrical connector having a retainer to prevent detachment of the cam lever from the connector body during transit, the retainer comprising a fin on each cam lever arm that is disposed in a channel of the connector body when the cam lever is in the transit position; the channels being provided by integral ears of the connector body that have substantially the same width as the cam lever arms, and the cam lever arms having flexible beams that include sockets that snap over lock pins projecting from the sides of the connector body for locked engagement with the connector body when the cam lever arms are in the lock position.

5. An electrical connector comprising:

a one-piece connector body having a resilient U-shaped cam lever comprising dual cam lever arms that are attached by a bridge and that are pivotally attached to the one-piece connector body for movement together between a transit position and a lock position, the cam lever arms being poised for engagement with a mating electrical connector when the cam lever arms are in the transit position, and the cam lever arms being configured for locked engagement with the connector body when the cam lever arm are in the lock position, the electrical connector having a lock for locking the cam lever in the transit position, the one-piece connector body having open ended channels formed by integral ears, of the one-piece connector body, and each of the dual cam lever arms having a radial fin that is disposed in one of the channels formed by the integral ears of the one-piece connector body when the cam lever arm is in the transit position to retain the cam lever in assembly with the one-piece connector body.

6. The electrical connector as defined in claim 5 wherein the integral ears of the connector body have substantially the same width as the cam lever arms to provide a low profile.

* * * * *